US011566770B2

(12) United States Patent
Niedenzu et al.

(10) Patent No.: US 11,566,770 B2
(45) Date of Patent: Jan. 31, 2023

(54) LIGHTING DEVICE FOR VEHICLES

(71) Applicants: HELLA GmbH & Co. KGaA, Lippstadt (DE); HELLA AUTOTECHNIK NOVA, s.r.o., Mohelnice (CZ)

(72) Inventors: Laura Niedenzu, Lippstadt (DE); Jan Sorbi, Mohelnice (CZ); Pavel Holous, Lestina (CZ); Sebastian Gatsios, Arnsberg (DE)

(73) Assignees: HELLA GmbH & Co. KGaA, Lippstadt (DE); HELLA AUTOTECHNIK NOVA, s.r.o., Mohelnice (CZ)

( * ) Notice: Subject to any disclaimer, the term of this patent is extended or adjusted under 35 U.S.C. 154(b) by 0 days.

(21) Appl. No.: 17/437,121

(22) PCT Filed: Mar. 27, 2019

(86) PCT No.: PCT/EP2019/025084
§ 371 (c)(1),
(2) Date: Sep. 8, 2021

(87) PCT Pub. No.: WO2020/192858
PCT Pub. Date: Oct. 1, 2020

(65) Prior Publication Data

US 2022/0178512 A1 Jun. 9, 2022

(51) Int. Cl.
*F21S 43/40* (2018.01)
*F21S 43/31* (2018.01)
*F21S 43/241* (2018.01)

(52) U.S. Cl.
CPC ..... *F21S 43/40* (2018.01); *F21S 43/241* (2018.01); *F21S 43/31* (2018.01)

(58) Field of Classification Search
CPC ..... F21S 43/241; F21S 43/31; F21S 43/40
See application file for complete search history.

(56) References Cited

U.S. PATENT DOCUMENTS 4,740,871 A 4/1988 Dilouya
6,296,382 B1 10/2001 Hamelbeck
(Continued)

FOREIGN PATENT DOCUMENTS

CN 109488988 A 3/2019
DE 102010003298 A1 9/2011
(Continued)

OTHER PUBLICATIONS

International Search Report dated Dec. 12, 2019, in International Application No. PCT/EP2019/025084.
(Continued)

*Primary Examiner* — Anabel Ton
(74) *Attorney, Agent, or Firm* — Patent Central LLC; Stephan A. Pendorf

(57) ABSTRACT

A lighting device for vehicles with a number of light sources, a number of reflectors reflecting the light emitted by the light sources into a specified main reflection direction, a number of diffusers scattering the light emitted by the light sources and a lens which is disposed in main reflection direction in front of the reflector and the diffuser. The lens is disposed at a v-shaped angle of a surface normal of the lens toward the main reflection direction of the reflector. A theoretical prolongation of the diffuser in relation to the surface normal of the lens extends in an acute angle of incidence or vertically to the lens. The diffuser is disposed as a separating wall between two reflectors which are disposed on stepped, offset levels and/or the diffuser is disposed as an end wall at a reflector.

15 Claims, 3 Drawing Sheets

(56) References Cited

U.S. PATENT DOCUMENTS

Figure 1:
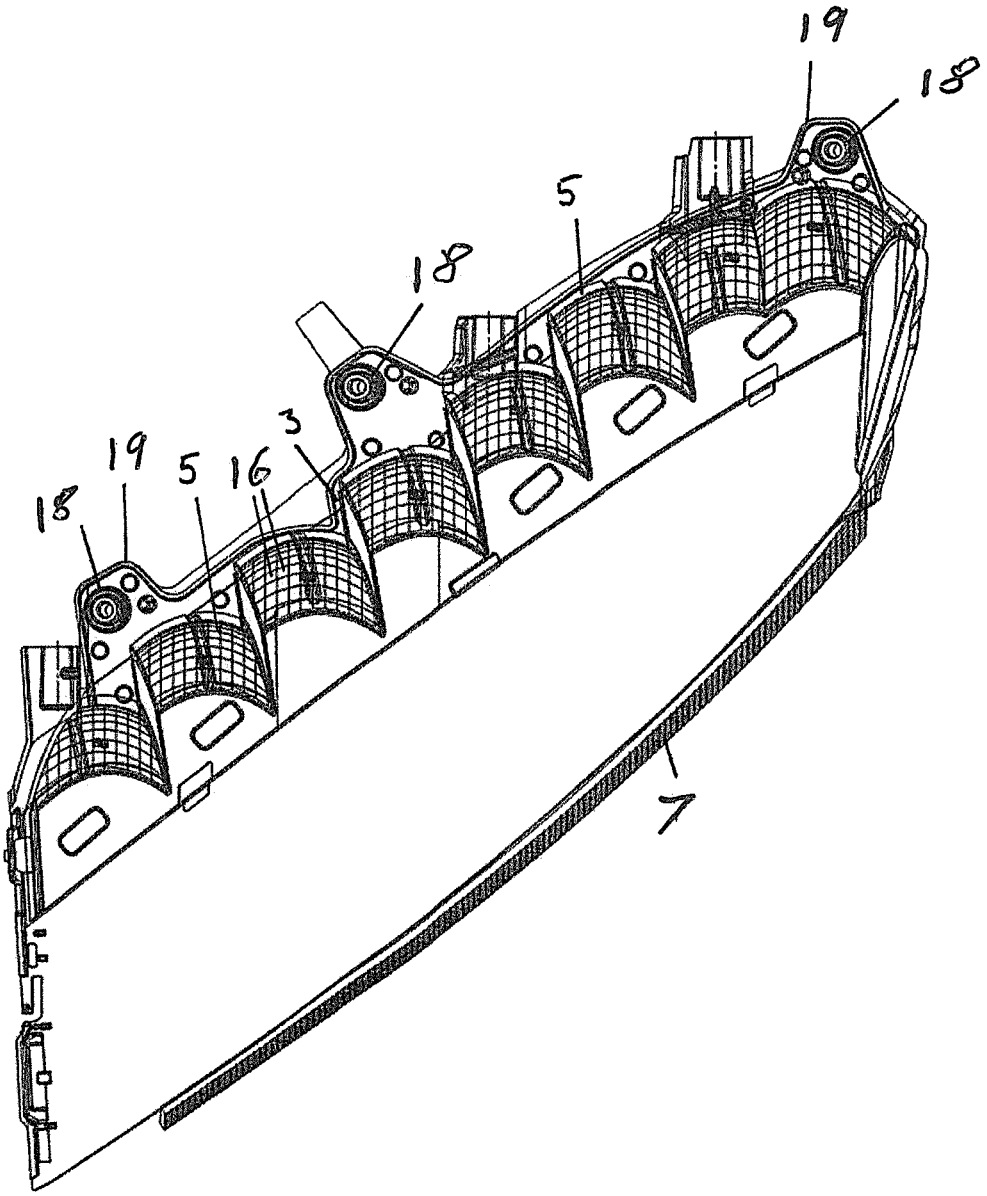

| | | | |
|---|---|---|---|
| 6,499,870 | B1 | 12/2002 | Zwick et al. |
| 9,869,444 | B2 | 1/2018 | Choi |
| 2019/0041024 | A1 | 2/2019 | Yamaguchi et al. |

FOREIGN PATENT DOCUMENTS

| | | | | |
|---|---|---|---|---|
| DE | 102015109816 | A1 | | 12/2016 |
| EP | 0955207 | A2 | | 11/1999 |
| EP | 0999405 | A2 | | 5/2000 |
| EP | 2045514 | A1 | | 4/2009 |
| FR | 2590351 | A1 | | 5/1987 |
| JP | 2015060797 | A | * | 3/2015 |
| JP | 2015060797 | A | | 3/2015 |

OTHER PUBLICATIONS

PCT Notification of Transmittal of the International Search Report and the Written Opinion of the International Searching Authority, or the Declaration, dated Dec. 12, 2019, in International Application No. PCT/EP2019/025084.

* cited by examiner

LIGHTING DEVICE FOR VEHICLES

The invention relates to a lighting device for vehicles with a number of light sources, a number of reflectors reflecting the light emitted by the light sources into a specified main reflection direction, a number of diffusers scattering the light emitted by the light sources and a lens which is disposed in main reflection direction in front of the reflector and the diffuser.

From U.S. Pat. No. 9,869,444 B2, a lighting device for vehicles is known, which is characterised by light sources which are each assigned a specular reflector on the one hand and a white diffuser on the other hand. The reflector enables the deflection and/or reflection of the light into a specified light radiation direction. The diffuser scatters incident light according to the Lambert law, which, means that the luminous intensity is always identical, regardless of the viewing angle. The diffuser extends relatively parallel to a light emitting surface of the lighting device. In this manner, a relatively homogenous light emission over a large surface is provided. This allows to create a comparatively flat lighting device. As the light emitting side and/or lens disposed in front of the reflector and the diffuser in the direction of the light radiation is disposed mainly vertically to the main radiation direction of the lighting device, illumination in lateral direction is possible only with a comparatively low luminous intensity. To this end, the lighting device would need a housing with a pronounced V-shape with a V-shaped lens and/or lens disposed at an angle to the main radiation direction and/or longitudinal axis of the vehicle.

From DE 10 2015 109 816 A1 a lighting device for vehicles is known, which is characterised by a v-shaped housing and/or a v-shaped lens, so that the lighting device can be disposed in a corner area of the vehicle. The lighting device features a number of light sources and one reflector allocated to each of the light sources. By means of the reflector, the light is reflected towards the longitudinal axis of the vehicle as well as in transverse to the longitudinal axis of the vehicle. In the internal space between the reflectors and the lens, additional elements are disposed which prevent radiation of the light in lateral direction. However, without the additional elements, local light concentrations would result.

The task of the present invention is thus to enhance a lighting device for vehicles in such a manner that a homogenous luminous intensity is warranted for lateral viewing angles.

To solve this task, the invention—in combination with the preamble of patent claim 1—is characterized by an arrangement, whereby the lens is disposed at a v-shaped angle of a surface normal of the lens toward the main reflection direction of the reflector, whereby a theoretical prolongation of the diffuser in relation to the surface normal of the lens extends in an acute angle of incidence or vertically to the lens, whereby the diffuser is disposed as a separating wall between two reflectors which are disposed on stepped, offset levels and/or whereby the diffuser is disposed as an end wall at a reflector.

The invention provides for a v-shaped lighting device which is characterised by a v-shaped lens. The lens extends at a v-shaped angle to the main reflection direction of reflectors and/or a main radiation direction of the lighting device. The v-shaped lighting device is intended for positioning in a corner area of a vehicle in such a manner that light is not only radiated in the direction of the longitudinal axis of the vehicle but also in lateral direction, i. e. in a transverse direction to the vehicle. The invention provides for a diffuser as separating wall and/or end wall, enabling homogenous reflection of light in a lateral direction. While the reflector with its main reflection direction defines a main radiation direction of the lighting device which is preferably oriented at the direction of the longitudinal axis of the vehicle, the diffuser causes a homogenous scattering of the light in transverse direction to the main reflection direction or in transverse direction of the longitudinal axis of the vehicle, permitting that a homogenous luminous intensity without light concentrations (hot spots) is achieved at lateral viewing angles. When the diffuser is designed as a separating wall, it serves as connection between two reflectors disposed in levels offset towards each other. When the diffuser is designed as end wall, the space between the end-side reflector and the lens may be used for lateral light emission.

According to one preferred embodiment of the invention, a first end of the separating wall forms an obtuse angle with one end of a first reflector, and a second end of the same separating wall forms an acute angle with the end of a second reflector. The space between two reflectors (first and second reflector) which are disposed on offset steps is thus filled with a separating wall and the light striking it can be utilised for homogenous lateral radiation.

According to an enhancement of the invention, a theoretical extension of the separating wall and/or the end wall encloses an acute angle of incidence of less than 50° with a surface normal of the lens. The angle of incidence runs on a horizontal plane. The surface normal of the separating wall and/or end wall thus runs in a lateral or backwards direction in relation to the main reflection direction of the reflectors. The orientation of the separating wall and/or end wall facilitates a homogenous lateral radiation.

According to an enhancement of the invention, a number of light sources is arranged in rows, with the row of light sources located on a horizontal plane or spanning a horizontal surface intersecting a number of reflectors and a number of diffusers. The light sources may for example be disposed on an upper or lower level or laterally, whereas the reflectors and diffusers extend underneath this light source level. The light from the light sources may thus impinge on the reflectors and diffusers directly or indirectly, which means that a homogenous emission is warranted.

According to an enhancement of the invention, a reflector support component carrying the reflectors has been provided for, forming one single manufacturing component. The reflector support component features an opening between the reflectors, into which the separating wall may be inserted. The separating walls are preferably connected with each other in one piece, forming the diffuser support component. A definite relative position of the reflectors towards the separating walls can be easily achieved by appropriate mounting of the reflector support component and the diffuser support component.

According to an enhancement of the invention, the reflector support component features a level retaining plane and the diffuser support component features a level supporting plane, which are in firm contact over their entire surface in mounted position. The diffuser support component thus serves as carrier for the reflector support component. The advantage is that this enables easier assembly and an enhanced stability of the reflector support component.

According to an enhancement of the invention, the supporting plane of the diffuser support component features light distribution material so that a diffuse reflection effect similar to that of the separating wall and the end wall is achieved. The supporting plane for example features the same surface material as the separating walls and the end walls.

Additional benefits of the invention can be derived from the other sub-claims.

One example for an embodiment of the invention will be explained in more detail below, based on the drawings.

Figure 2:
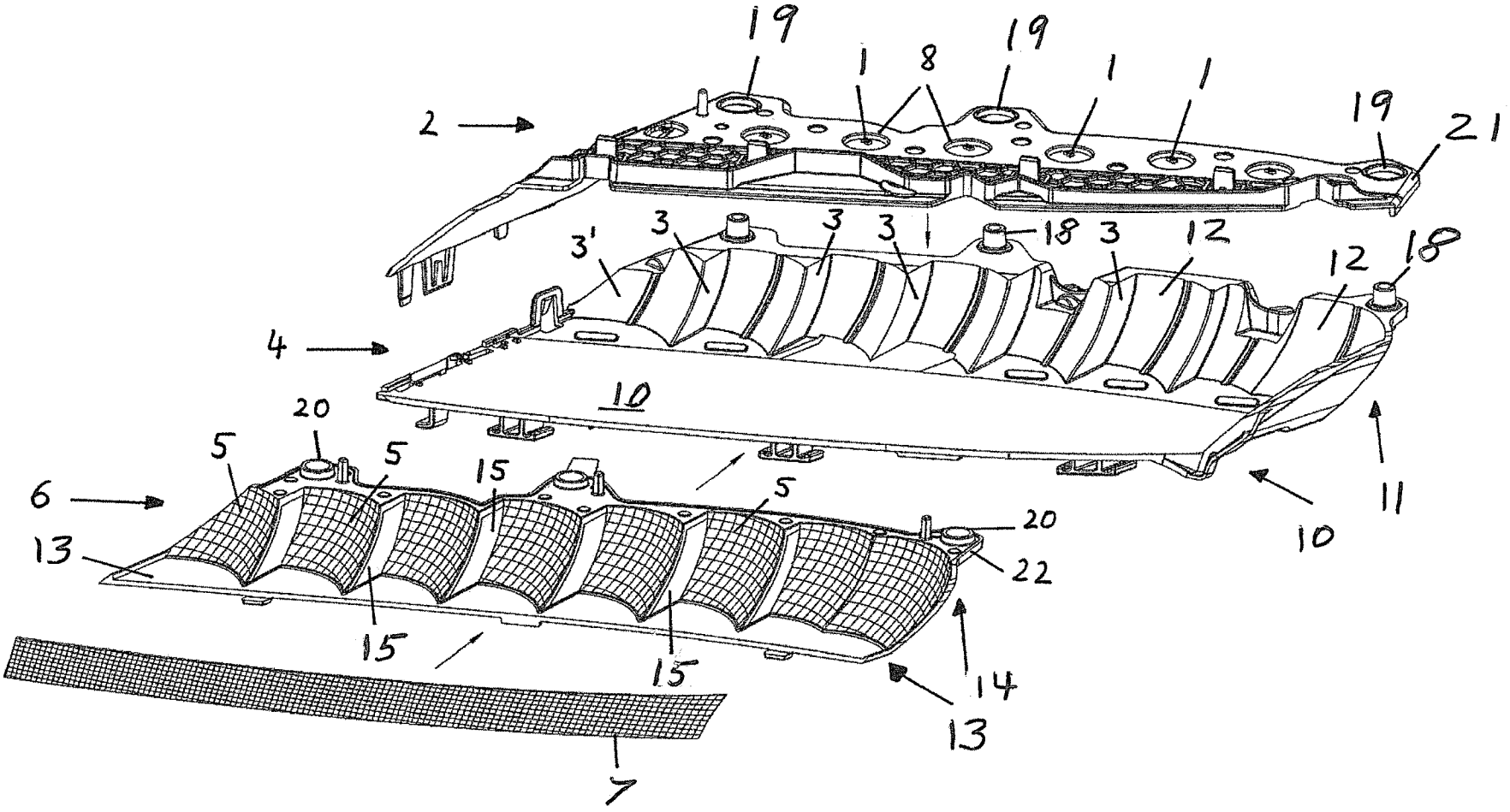

The following is shown:

FIG. 1 perspective front view of a lighting device according to the invention, shown diagonally from above, without housing and with a lens disposed in main radiation direction at the front;

FIG. 2 exploded view of the lighting device according to FIG. 1 and a schematic horizontal section through the lighting device.

A lighting device according to the invention is designed as a v-shaped lighting device which can be disposed in a corner area of a vehicle. The lighting device can, by way of example, serve to create a daytime running light, position light or indicator light function.

The lighting device essentially features a light source support component 2 fitted with a number of light sources 1, a diffuser support component 4 featuring a number of diffusers 3, 3', a reflector support component 6 featuring a number of reflectors 5 and a lens 7, all of which are disposed inside a lighting device housing which is not shown. The housing of the lighting device has a pot-shaped design and is closed with a closure lid 23 shown in FIG. 3.

The light source support component 2 has a flat and/or level design and features openings 8 through which the light 9 emitted by light source 1 can pass or in which the light sources 1 are disposed. The light sources 1 are preferably disposed on a circuit board (not shown) which is attached to the light source support component 2. The optical axes A of the light sources 1 run in a vertical direction. The light sources 1 are disposed in a manner that they emit the light 9 vertically downwards. The light sources 1 may, for example, be designed as LED-light sources.

Die diffuser support component 4 features a flat front section 10 and an upright section 11, with the upright section 11 rising from the rear side of the flat section 10. Die upright section 11 features the diffusers 3, 3', which are arranged in a row and have a scattering effect. The surface of the diffusers 3, 3' may, for example, be designed as a white or grey surface. Neighbouring diffusers 3, 3' are arranged at a distance to each other. One reflector fitting plane 12 extends between each pair of neighbouring diffusers 3, 3'; with the lighting device in mounting position, these are fitted flush with the full backside of the reflectors 5. The reflector fitting plane 12 is adapted to the shape of the allocated reflectors 5. The reflector fitting plane 12 features the same surface characteristics as the diffusers 3, 3'. The flat section 10 forms a supporting plane for the reflector support component 6. The supporting plane 10 may feature light distribution material so that the light 9 striking it is scattered. For example, the surface of this section may like the diffusers 3, 3' and the reflector fitting surface 12 be designed as a white, or grey surface. The diffuser support component 4 is designed as one piece.

The reflector support component 6 features a flat section 13 and an upright section 14 connected to the rear side of the flat section. The upright section 14 features the reflectors 5, which are arranged at certain distances to each other in the direction of extension E of Section 14. Between neighbouring reflectors 5, openings 15 are provided for, into which those diffusers 3 engage which are not disposed at the sides. Each of the reflectors 5 features a number of bevels 16 serving light distribution purposes and has, for example, a parabola shape, with one main reflection direction R of the reflectors 5 running in the same direction as the longitudinal axis of the vehicle and/or the longitudinal direction of the vehicle. The cushion-shaped bevels 16 facilitate scattering of the light 9 striking them in vertical and horizontal direction. Alternatively, the reflectors 5 may feature other light distribution elements, for example horizontal flutings for vertical scattering or vertical flutings for horizontal scattering of the light 9 or they may also feature other surface structures. The flat section 13 forms a retaining plane fitted flush with the surface of supporting plane 10 of the diffuser support component 4. As shown in FIG. 2, the reflector support component 6 is essentially pushed onto the diffuser support component 4 from the front and then fixed to it. In mounted position, the flat section 13 as well as the upright section 14 of the reflector support component 6 rest against the flat section 10 and/or the upright section 11 of the diffuser support component 4. Thus, a definite relative position of the reflectors 5 towards the diffusers 3, 3' is warranted. The diffusers 3 disposed at the edges for example, end flush with an edge of the openings 15 in the diffuser support component 4.

In front of the diffuser support component 4 and the reflector support component 6, in main radiation direction R, lens 7 is disposed, featuring light distribution elements.

As shown in FIG. 2, the diffuser support component 4 features upright bolts 18 as fastening material; in mounted position, these engage into the perforations 19, 20 of flanges 21, 22 of the light source support component 2 and/or of the reflector support component 6.

Figure 3:
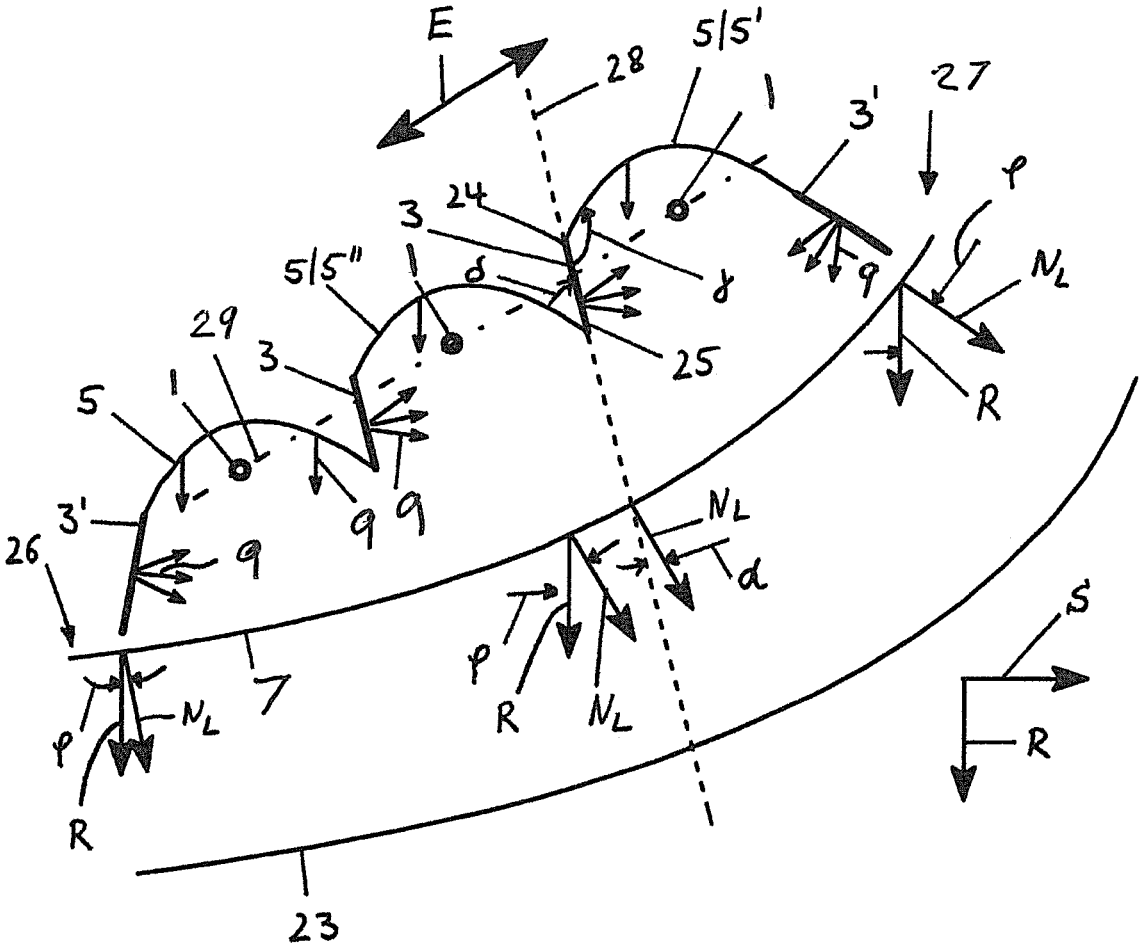

FIG. 3 shows that the upright section 11 of diffuser support component 4 and the upright section 14 of the reflector support component 6 run in a direction of extension E which runs generally parallel to lens 7 and closure lid 23. The direction of extension E runs in a v-shaped angle towards the main radiation direction of the lighting device and/or the main reflection direction R of reflectors 5. The reflectors 5 and/or the diffusers 3 are arranged in steps.

Diffusers 3 disposed internally and/or not at the edges are designed as separating walls extending between neighbouring reflectors 5. The diffusers 3' at the edges are designed as end walls extending from one free end of an end-side reflector 5 towards lens 7, As the reflectors 5 are arranged in one single horizontal row, the diffuser support component 4 features two end walls 3'.

The internal diffusers 3 are like the reflectors 5 disposed on stepped levels offset to each other. The separating walls 3 connect the ends of neighbouring reflectors 5 which are facing each other. Separating wall 3 for example connects at its end a first reflector 5' with a second reflector 5". A first end 24 of separating wall 3 facing the first reflector 5' extends to one end of the first reflector 5', with the first end 24 of separating wall 3 and the end of the first reflector 5' enclosing an obtuse angle $\gamma$. A second end 25 of the same separating wall 3 runs into the direction of one end of the second reflector 5", with the second end 25 of separating wall 3 and the end of the second reflector 5" enclosing an acute angle $\delta$.

The end walls 3' run in a prolongation of the end-side reflectors 5 in such a way that they do not enclose an acute angle $\delta$ with the end of the end-side reflector 5.

Lens 7 is disposed so that it forms a v-shaped angle $\varphi$ with the main radiation direction of the lighting device and/or the main reflection direction R of the reflectors 5. As shown in FIG. 3, the surface normal $N_L$ of lens 7 encloses the v-shaped angle $\varphi$ towards the main reflection direction R.

The v-shaped angle φ rises continuously from a first end 26 of lens 7 towards a second end 27 of the same. While the v-shaped angle φ in the area of the first end 26 of lens 7 is comparatively narrow with just a few degrees, the v-shaped angle φ in the area of the second end 27 varies between 80° and 90°.

A theoretical prolongation 28 of the separating walls 3 impinges lens 7 vertically or at an acute angle of incidence α. In terms of size, the angle of incidence α is smaller than the v-shaped angle φ. The angle of incidence α running in horizontal direction is smaller than 50°, preferably smaller than 30'.

While the reflectors 5, 5', 5" are designed to radiate the light in the main reflection direction R, the separating walls 3 and/or the end walls 3' have the effect that the incident light 9 is scattered in lateral direction S, i.e. transversal to the main reflection direction R and/or the longitudinal axis of the vehicle. The light 9 emitted by the light sources 1 can directly strike the reflectors 5, 5', 5", and it can also directly strike the separating walls 3 and the end walls 3'. Where applicable, the light 9 reflected at the reflectors 5, 5', 5" may strike the separating walls 3 and/or the end walls 3', so that it is reflected or scattered in lateral direction S. Where applicable, the light 9 scattered by the separating walls 3 and/or the end walls 3' may also strike the reflectors 5, 5', 5". All in all, this results in a homogenous light emission in the main reflection direction R as well as in lateral direction S.

It can be seen that each light source 1 has been allocated one single reflector 5 and one single separating wall 3.

The light sources 1 are disposed in one row, with the individual light sources 1 disposed in main reflection direction R in front of the corresponding reflectors 5. A theoretical vertical connecting level 29 on which the light sources 1 are disposed, intersects the majority of the reflectors 5 and the separating walls 3.

The separating walls 3 and the end walls 3' are preferably designed flat.

Alternatively, the separating walls 3 and the end walls 3' may also have a slightly curved shape. The surfaces of the separating walls 3 and/or the end walls 3' are preferable designed as smooth walls. Alternatively, the separating walls 3 and/or the end walls 3' may feature light distribution optics.

It is clear that the characteristics indicated above may be utilised each by itself or in various combinations. The design example described above is not to be interpreted as the final listing.

The invention claimed is:

1. A lighting device for vehicles comprising:

a number of light sources (1);

a number of reflectors (5, 5', 5"), by which light (9) emitted by the light sources (1) is reflected in a predetermined main reflection direction (R);

a number of diffusers (3, 3'), by which the light (9) emitted by the light sources (1) is scattered;

a lens (7) disposed in the main reflection direction (R) in front of the reflector r (5, 5', 5") and the diffuser (3, 3');

wherein the lens (7) is disposed at a v-shaped angle (φ) between a surface normal (NL) of the lens (7) and the main reflection direction (R) of the reflector (5, 5', 5");

the diffuser (3, 3') is disposed as at least one separating wall (3) between two reflectors (5, 5', 5") disposed on stepped, offset levels and/or as an end wall (3') at a reflector (5), wherein the separating wall (3) and/or the end wall (3') have a flat or a slightly curved shape and/or feature light distribution optics; and the flat or slightly curved wall (3) is oriented such that an imaginary continuation (28) of the flat or slightly curved wall (3) in relation to the surface normal (NL) of the lens (7) intersects the lens (7) at an acute angle of incidence (α) or perpendicular to the lens (7).

2. The lighting device of claim 1, wherein a first end (24) of the separating wall (3) facing a first reflector (5, 5') encloses an obtuse angle (γ) with an end of the first reflector (5, 5') facing the same wall and that a second end (25) facing a second reflector (5, 5') of the same separating wall (3) encloses an acute angle (δ) with the end of the second reflector (5, 5') facing the same wall.

3. The lighting device of claim 2, wherein the first reflector (5') is disposed opposite to the main reflection direction (R) on an offset level to the second reflector (5").

4. The lighting device of claim 1, wherein the angle of incidence (α) running on a horizontal plane is smaller than 50°.

5. A lighting device for vehicles comprising:

a number of light sources (1);

a number of reflectors (5, 5', 5"), by which light (9) emitted by the light sources (1) is reflected in a predetermined main reflection direction (R);

a number of diffusers (3, 3'), by which the light (9) emitted by the light sources (1) is scattered;

a lens (7) disposed in the main reflection direction (R) in front of the reflector r (5, 5', 5") and the diffuser (3, 3');

wherein the lens (7) is disposed at a v-shaped angle (φ) between a surface normal (NL) of the lens (7) and the main reflection direction (R) of the reflector (5, 5', 5");

the diffuser (3, 3') is disposed as a separating wall (3) between two reflectors (5, 5', 5") disposed on stepped, offset levels and/or as an end wall (3') at a reflector (5), and the flat or curved wall (3) is oriented such that an imaginary continuation (28) of the flat or slightly curved separating wall (3) in relation to the surface normal (NL) of the lens (7) intersects the lens (7) at an acute angle of incidence (α) or perpendicular to the lens (7), and one single reflector (5, 5', 5") and one single separating wall (3) are allocated to each of the light sources (1).

6. The lighting device of claim 1, wherein a number of light sources (1) is provided which are disposed in a row in certain intervals to each other and wherein the row of light sources (1) is located on a vertical plane (29) or spanning a vertical surface intersecting a number of reflectors (5, 5', 5") and a number of diffusers (3).

7. The lighting device of claim 1, wherein the end wall (3') of an end-side reflector (5) out of the majority of reflectors (5) runs in the direction of the lens (7).

8. The lighting device of claim 1, wherein the reflectors (5, 5', 5") are connected with each other in one piece, forming a reflector support component (6), with the reflector support component (6) featuring the reflectors (5) and an opening (15) disposed between neighbouring reflectors (5) which holds the separating wall (3).

9. The lighting device of claim 1, wherein the separating wall (3) and/or at least one end wall (3') are connected with each other in one piece, forming a diffuser support component (4).

10. The lighting device of claim 1, wherein the diffuser support component (4) features reflector fitting surfaces (12) adapted to the shape of the reflectors (5, 5', 5") which are each disposed in the direction of extension (E) of the diffuser support component (4) and which are located between two separating walls (3).

11. The lighting device of claim 1, wherein the diffuser support component (4) features a supporting plane (10) projecting from the diffusers (3, 3') and the reflector fitting surface (12) towards the lens (7).

12. A lighting device for vehicles comprising:

a number of light sources (1);

a number of reflectors (5, 5', 5"), by which light (9) emitted by the light sources (1) is reflected in a predetermined main reflection direction (R);

a number of diffusers (3, 3'), by which the light (9) emitted by the light sources (1) is scattered;

a lens (7) disposed in the main reflection direction (R) in front of the reflector r (5, 5', 5") and the diffuser (3, 3');

wherein the lens (7) is disposed at a v-shaped angle (φ) between a surface normal (NL) of the lens (7) and the main reflection direction (R) of the reflector (5, 5', 5");

the diffuser (3, 3') is disposed as a separating wall (3) between two reflectors (5, 5', 5") disposed on stepped, offset levels and/or as an end wall (3') at a reflector (5), the flat or slightly curved wall (3) is oriented such that an imaginary continuation (28) of the flat or slightly curved separating wall (3) in relation to the surface normal (NL) of the lens (7) intersects the lens (7) at an acute angle of incidence (α) or perpendicular to the lens (7), and the diffusers (3, 3') feature a white or grey surface.

13. The lighting device of claim 1, wherein the reflector (5, 5', 5") features light distribution optics (16) deflecting the light (9) in a vertical and/or horizontal direction.

14. The lighting device of claim 1, wherein the reflector support component (6) features a retaining plane (13) projecting from the reflectors (5) in the direction of lens (7) which is fitted flush with the surface of supporting plane (10) of the diffuser support component (4).

15. The lighting device of claim 1, wherein the angle of incidence (α) running on a horizontal plane is smaller than 30°.

* * * * *